US006653785B2

(12) United States Patent
Takagaki et al.

(10) Patent No.: US 6,653,785 B2
(45) Date of Patent: Nov. 25, 2003

(54) ARC TUBE WITH PINCH SEAL AND DIMENSIONAL RELATIONSHIP AND METHOD FOR FORMING THE SAME

(75) Inventors: Michio Takagaki, Shizuoka (JP); Masaya Shido, Shizuoka (JP); Yukihiro Kobayakawa, Shizuoka (JP); Masayuki Umehara, Shizuoka (JP); Nobuyuki Kasuya, Shizuoka (JP); Takeshi Fukuyo, Shizuoka (JP); Yoshitaka Ohshima, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 36 days.

(21) Appl. No.: 10/000,018

(22) Filed: Dec. 4, 2001

(65) Prior Publication Data

US 2002/0105272 A1 Aug. 8, 2002

(30) Foreign Application Priority Data

Dec. 5, 2000 (JP) ..... P. 2000-370609

(51) Int. Cl.[7] ..... H01J 61/36

(52) U.S. Cl. ..... 313/623; 313/318.07

(58) Field of Search ..... 313/623, 318.07, 313/318.01; 445/26

(56) References Cited

U.S. PATENT DOCUMENTS

| | | | |
|---|---|---|---|
| 5,877,590 A | 3/1999 | Fukuyo et al. | 313/623 |
| 5,936,349 A | 8/1999 | Fukai et al. | 313/623 |
| 5,962,976 A | 10/1999 | Irisawa et al. | 313/623 |

*Primary Examiner*—Ashok Patel
*Assistant Examiner*—Glenn Zimmerman
(74) *Attorney, Agent, or Firm*—Sughrue Mion, PLLC

(57) ABSTRACT

An arc tube and method for forming an arc tube in which an electrode assembly including a tungsten electrode and a molybdenum foil are joined together in a partially overlapped state and pinch sealed into a pinch seal portion of the arc tube body to suppress leakage due to peeling of the molybdenum foil and prolong the life period of the arc tube. An overlapped length L1 of a tungsten electrode and a molybdenum foil is set to be $2D \leqq L1 \leqq 0.8W$ with respect to the diameter D of the tungsten electrode and the width W of the molybdenum foil. In another embodiment, the distance L2 between the molybdenum foil and a discharge space is set to be $B \leqq L2 \leqq 0.8A$ with respect to the width A and the thickness B of a pinch seal portion.

11 Claims, 14 Drawing Sheets

ARC TUBE WITH PINCH SEAL AND DIMENSIONAL RELATIONSHIP AND METHOD FOR FORMING THE SAME

BACKGROUND OF THE INVENTION

1. Field of the Invention

The present invention relates to an arc tube and a method for forming an arc tube for a discharge bulb, and more particularly, to an arc tube and method for forming an arc tube that can be used as a light source such as for an automobile headlight.

2. Description of the Related Art

An arc tube is generally used to provide high luminance irradiation. Recently, therefore, an arc tube is frequently used also as a light source for an automobile headlight.

As shown in FIG. 17, an arc tube which is used in an automobile headlight or the like is usually configured by an arc tube body 104 which is made of quartz glass, and in which pinch seal portions 104*b* are formed in ends of a luminous tube portion 104*a* constituting a discharge space 102. The arc tube includes a pair of electrode assemblies 106 in which a tungsten electrode 108 and a lead wire 110 are connected and fixed to each other via a molybdenum foil 112. Each of the electrode assemblies 106 is pinch sealed into the arc tube body 104 in the corresponding pinch seal portion 104*b* with protruding a tip end part of the tungsten electrode 108 into the discharge space 102. As a result of this pinch sealing, the molybdenum foil 112 is joined to the arc tube body 104 in a state where the foil is embedded in the arc tube body 104.

The connection and fixation between the tungsten electrode 108 and the molybdenum foil 112 are performed by welding together the members in a partially overlapped state. In the periphery of the overlapped portion, however, it is not easy to sufficiently ensure a force of joining the molybdenum foil 112 and the arc tube body 104. In a conventional arc tube, therefore, the molybdenum foil 112 is easily peeled off while the arc tube is in use.

When such peeling occurs, the arc tube body 104 cracks, typically starting from an edge of a joining face between the molybdenum foil 112 and the arc tube body 104. As the crack grows, it causes a leakage between the discharge space 102 and the external space. Consequently, the life period of a conventional arc tube becomes relatively short.

SUMMARY OF THE INVENTION

The invention has been conducted in view of such circumstances. It is an object of the invention to provide an arc tube and a method for forming an arc tube in which leakage due to peeling of a molybdenum foil is effectively suppressed so that the life period of the arc tube can be prolonged.

The present inventors have discovered that when consideration is given to dimensional relationships among components in the periphery of the overlapped portion of a tungsten electrode and a molybdenum foil, occurrence of peeling of the molybdenum foil may be effectively suppressed without adversely affecting other characteristics. In view of this discovery, an object of the present invention is attained by defining these dimensional relationships.

The arc tube of a first aspect of the invention is an arc tube comprising an arc tube body which is made of, for example, quartz glass, and in which pinch seal portions are formed in ends of a luminous tube portion constituting a discharge space, respectively; and a pair of electrode assemblies in each of which a tungsten electrode and a molybdenum foil are joined together, such as by welding, in a partially overlapped state, and which are pinch sealed into the arc tube body in the pinch seal portions, respectively, with protruding a tip end part of the tungsten electrode into the discharge space, wherein an overlapped length L1 of the tungsten electrode and the molybdenum foil is set to have the following relationship with a diameter D of the tungsten electrode and a width W of the molybdenum foil:

$$2D \leqq L1 \leqq 0.8W.$$

The arc tube of a second aspect of the invention is an arc tube comprising an arc tube body which is made of quartz glass, and in which pinch seal portions are formed in ends of a luminous tube portion constituting a discharge space, respectively; and a pair of electrode assemblies in each of which a tungsten electrode and a molybdenum foil are welded together in a partially overlapped state, and which are pinch sealed into the arc tube body in the pinch seal portions, respectively, with protruding a tip end part of the tungsten electrode into the discharge space, wherein a distance L2 between the molybdenum foil and the discharge space is set to have the following relationship with a width A and a thickness B of the pinch seal portion:

$$B \leqq L2 \leqq 0.8A.$$

The above-mentioned "tungsten electrode" is an electrode in which tungsten is a principal component.

The above-mentioned "molybdenum foil" is a foil in which molybdenum is a principal component.

Further, the range of "overlapped length L1" in the first aspect of the invention, and that of "distance L2" in the second aspect of the invention may be set to both pinch seal portions of the sides of the luminous tube portion, or to only one of the pinch seal portions.

As shown in the above configuration, in the arc tube of the first aspect of the invention, the overlapped length L1 of the tungsten electrode and the molybdenum foil which constitute an electrode assembly of the arc tube is set to be $2D \leqq L1 \leqq 0.8W$ with respect to the diameter D of the tungsten electrode and the width W of the molybdenum foil. Therefore, the arc tube can attain the following functions and effects.

In each of the electrode assemblies which are pinch sealed into an arc tube body, minute gaps are formed between the electrode assembly and the arc tube body in the periphery of a portion where the tungsten electrode and the molybdenum foil are welded together. The molybdenum foil is peeled off starting from such gaps. As the overlapped length L1 becomes longer, the proportion of the gaps becomes greater, and hence peeling of the molybdenum foil occurs more easily. As a result of temperature changes due to turning-on and turning-off of the arc tube, the tungsten electrode expands and contracts with respect to the arc tube body. As the overlapped length L1 becomes longer, the expansion and contraction of the tungsten electrode produce a greater stress. Also from this viewpoint, peeling of the molybdenum foil occurs easily. Therefore, reduction of the overlapped length L1 to a value which is as small as possible is effective in suppression of occurrence of leakage due to peeling of the molybdenum foil.

By contrast, when the overlapped length L1 is extremely reduced, it becomes physically impossible to join, for example, by welding, the tungsten electrode to the molybdenum foil. In this welding, moreover, there is the possibility that the molybdenum foil is broken in the portion overlapped by the tungsten electrode. Even in the case where the molybdenum foil is not broken in the welding step, when the overlapped length L1 is extremely reduced, the strength of the periphery of the welded portion of the molybdenum foil becomes largely reduced. Therefore, there is the possibility that the molybdenum foil is broken by the pinch seal pressure in the subsequent pinch sealing step, or that, when the arc tube is turned on, the current flow is concentrated in the welded portion to fuse off the welded portion.

When, based on the results of experiments conducted by the present inventors, the overlapped length L1 of the tungsten electrode and the molybdenum foil is set to a value within a range of $2D \leqq L1 \leqq 0.8W$ with respect to the diameter D of the tungsten electrode and the width W of the molybdenum foil as set forth in the first aspect of the invention, occurrence of peeling of the molybdenum foil can be effectively suppressed while effectively suppressing occurrence of breakage of the molybdenum foil. Therefore, occurrence of leakage due to peeling of the molybdenum foil can be effectively suppressed, so that the life period of the arc tube can be prolonged.

In the arc tube of the second aspect of the invention, the distance L2 between the molybdenum foil which constitutes an electrode assembly of the arc tube, and the discharge space is set to be $B \leqq L2 \leqq 0.8A$ with respect to the width A and the thickness B of the pinch seal portion. Therefore, the arc tube can attain the following functions and effects.

As the distance L2 between the molybdenum foil and the discharge space becomes shorter, the discharge luminous portion (the tip end part of the tungsten electrode) further approaches the molybdenum foil, and hence the temperature change of the overlapped portion of the tungsten electrode and the molybdenum foil becomes larger due to turning-on and turning-off of the arc tube. This increases the expansion and contraction of the tungsten electrode in the overlapped portion with respect to the arc tube body. Therefore, the stress produced in the molybdenum foil is increased so that peeling of the molybdenum foil easily occurs.

By contrast, when the distance L2 between the molybdenum foil and the discharge space becomes long, there arises the following problem. In a region in the vicinity of the joining face with the tungsten electrode in the arc tube body, usually, a crack which radially elongates from the joining face with the tungsten electrode, and that which circumferentially elongates so as to surround the tungsten electrode are caused by the difference in coefficient of thermal expansion between the tungsten electrode and the arc tube body (quartz glass). The former is called electrode cracking. When electrode cracking grows to reach the outer peripheral face of the arc tube body, leakage occurs between the discharge space and the external space. On the other hand, the latter is called bead cracking. When bead cracking is formed, the growth of electrode cracking is blocked. Bead cracking occurs under the condition that the temperature distribution in the axial direction of the area of the pinch seal portion where the tungsten electrode is embedded is approximately even. When the distance L2 between the molybdenum foil and the discharge space is long, however, the temperature distribution in the axial direction of the area of the pinch seal portion where the tungsten electrode is embedded is considerably uneven, so that bead cracking is hardly formed. Therefore, electrode cracking easily grows to reach the outer peripheral face of the arc tube body.

When, based on the results of experiments conducted by the present inventors, the distance L2 between the molybdenum foil and the discharge space is set to be $B \leqq L2 \leqq 0.8A$ with respect to the width A and the thickness B of the pinch seal portion as set forth in the second aspect of the invention, occurrence of peeling of the molybdenum foil can be effectively suppressed while effectively suppressing growth of electrode cracking. Therefore, occurrence of leakage due to peeling of the molybdenum foil can be effectively suppressed, so that the life period of the arc tube can be prolonged.

When an arc tube is configured by a combination of the first and second aspects of the invention, occurrence of peeling of the molybdenum foil can be effectively suppressed while effectively suppressing breakage of the molybdenum foil and growth of electrode cracking. Therefore, occurrence of leakage due to peeling of the molybdenum foil can be effectively suppressed, so that the life period of the arc tube can be further prolonged.

DETAILED DESCRIPTION OF THE INVENTION

Figure 1:
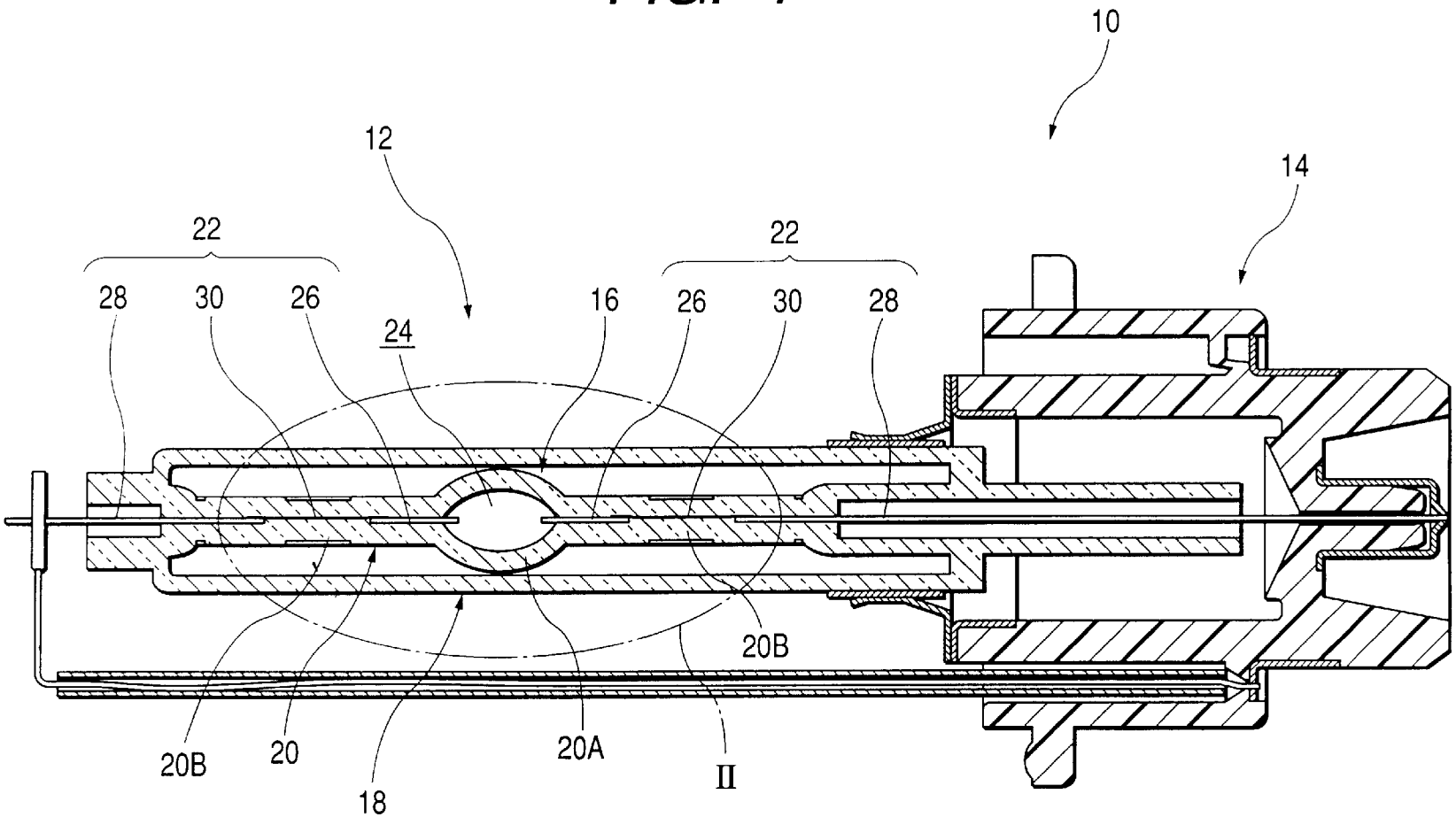
FIG. 1 is a side section view showing a discharge bulb into which an arc tube of an embodiment of the invention is incorporated.

Hereinafter, embodiments of the invention will be described with reference to the accompanying drawings. FIG. 1 is a side section view showing a discharge bulb 10 into which an arc tube of an embodiment of the invention is incorporated, FIG. 2 is an enlarged view of the portion II of the figure, and FIG. 3 is a section view taken along line III—III of FIG. 2.

Figure 2:
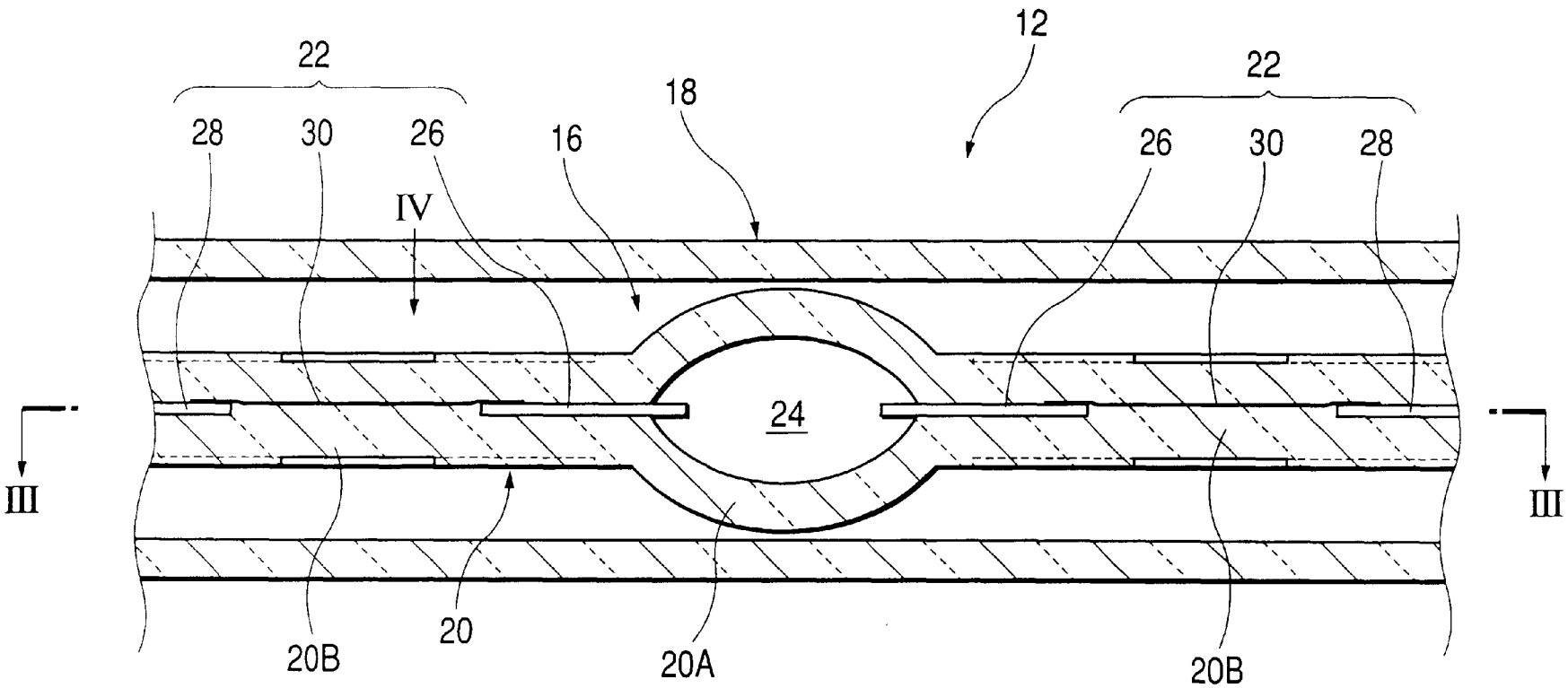
FIG. 2 is an enlarged view of the portion II of FIG. 1.
Figure 3:
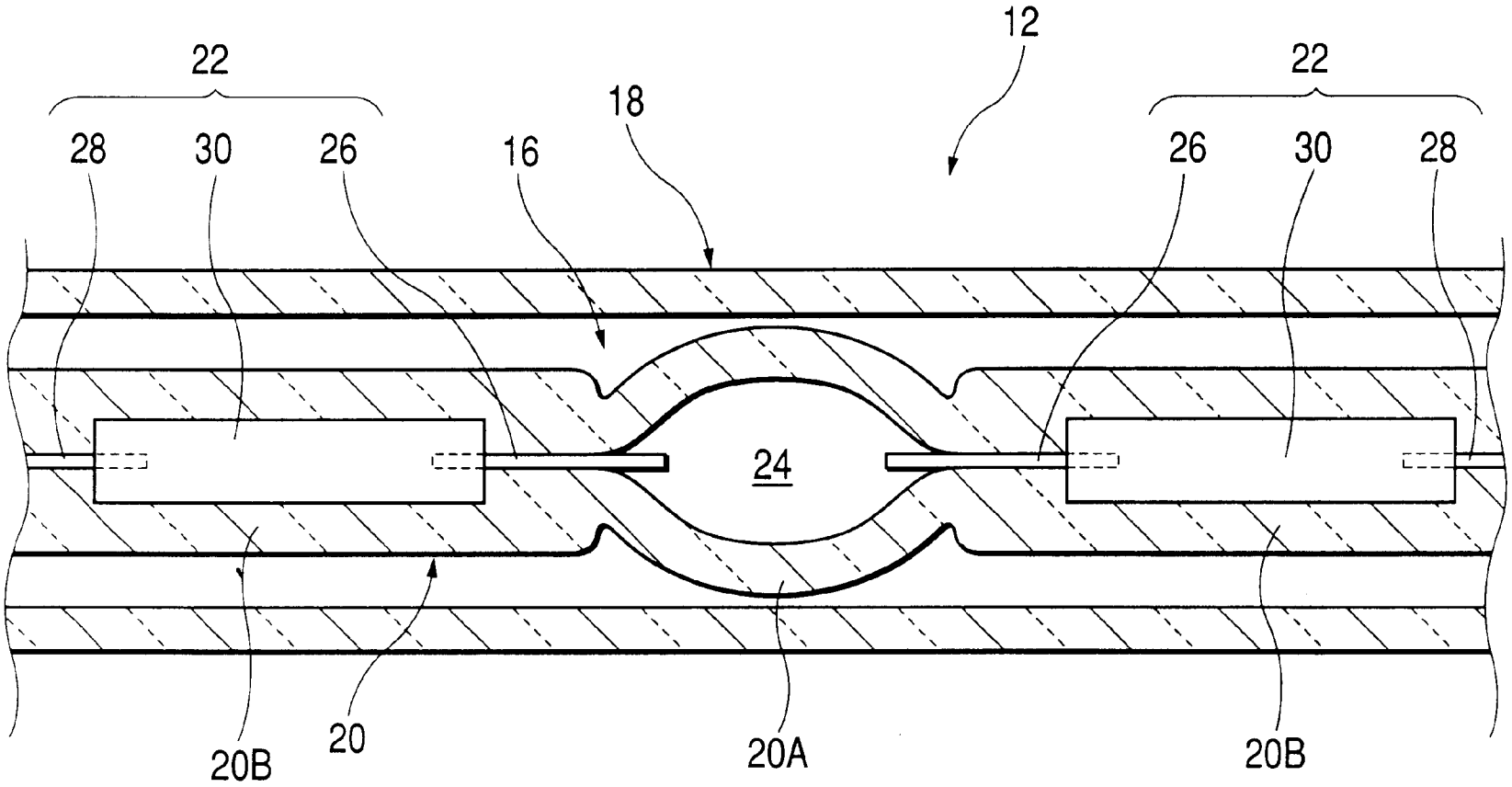
FIG. 3 is a section view taken along line III—III of FIG. 2.

As shown in FIGS. 1–3, the discharge bulb 10 is a light source bulb which may be attached to an automobile headlight, and comprises an arc tube unit 12 which may longitudinally elongate, and an insulating plug unit 14 which may fixedly support a rear end portion of the arc tube unit 12.

In the arc tube unit 12, an arc tube 16, and a shroud tube 18, which surrounds the arc tube 16, may be integrally formed. The arc tube 16 may be configured by the arc tube body 20 which may be formed by processing a quartz glass tube, and a pair of front and rear electrode assemblies 22 which may be embedded in the arc tube body 20.

In the arc tube body 20, a luminous tube portion 20A having a substantially elliptical or spherical shape may be formed in the center, and pinch seal portions 20B may be formed in the front and rear sides of the tube portion, respectively. A discharge space 24 which has a substantially elliptical or spherical shape, and which longitudinally elongates is formed inside the luminous tube portion 20A. The discharge space 24 may be filled with, for example, mercury, xenon gas, and a metal halide.

Each of the electrode assemblies 22 may be configured by connecting and fixing a rod-like electrode, such as a tungsten electrode 26 and a lead wire 28 to each other by welding via a molybdenum foil 30, and pinch sealed into the arc tube body 20 in the corresponding pinch seal portion 20B. In the pinch sealing, the whole of each of the tungsten electrodes 26 other than the tip end part may be embedded in the corresponding pinch seal portion 20B under a state where the tip end parts of the electrodes are protruded respectively from the front and rear sides into the discharge space 24 so as to be opposed to each other. The whole of each of the molybdenum foils 30 may be embedded in the corresponding pinch seal portion 20B.

Figure 4:
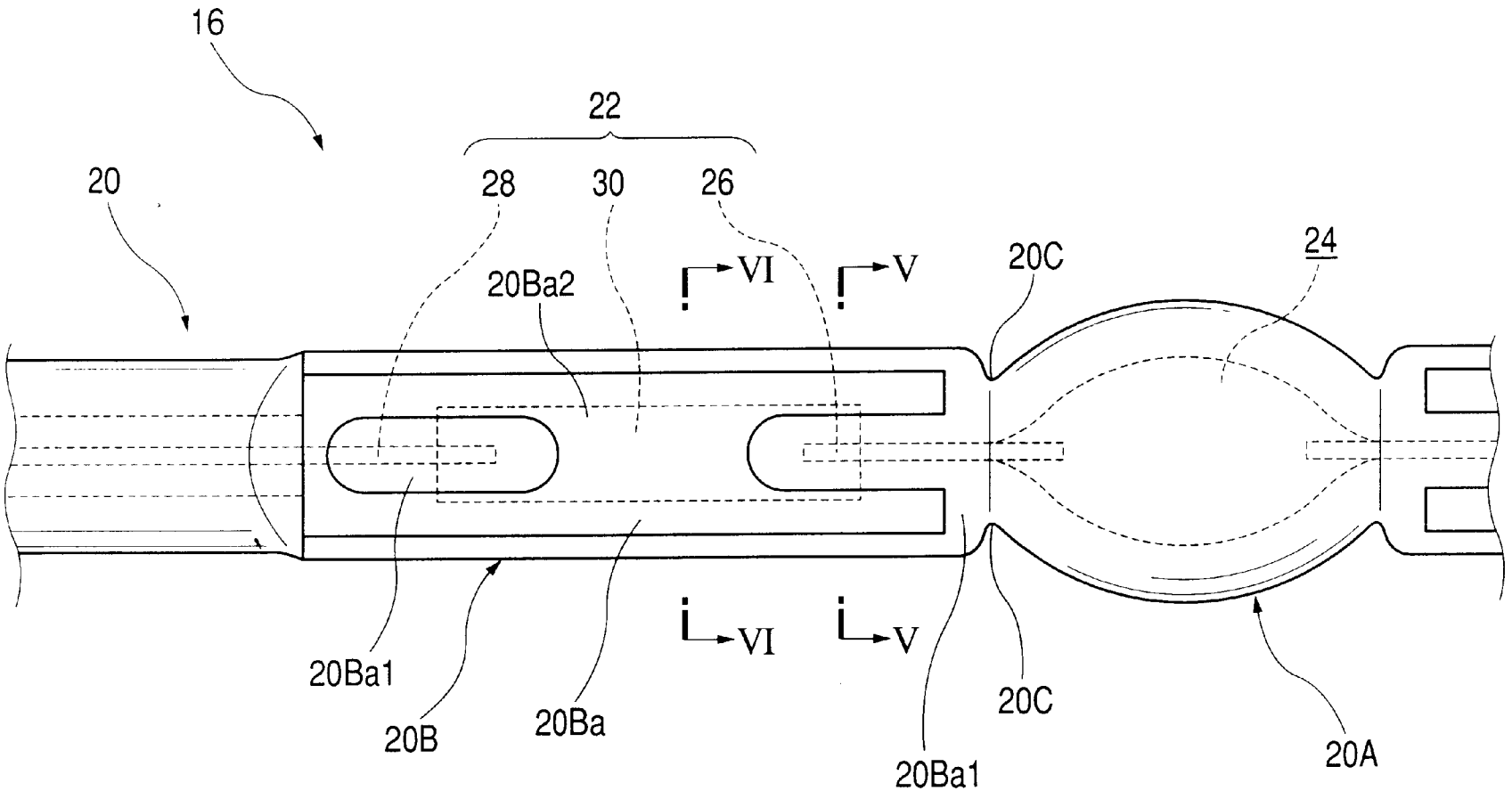
FIG. 4 is a view looking in the direction the arrow IV of FIG. 2.
Figure 6:
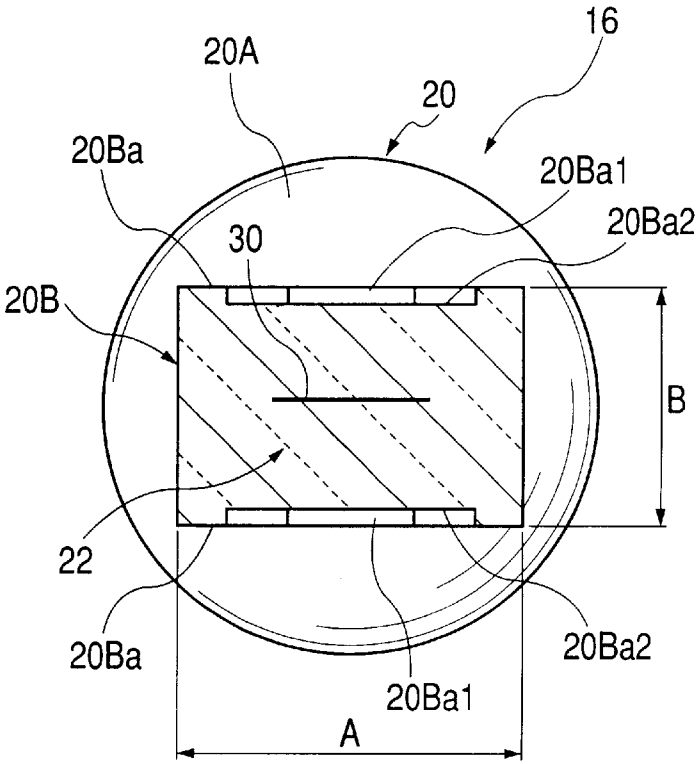
FIG. 6 is a section view taken along line VI—VI of FIG. 4.
Figure 5:
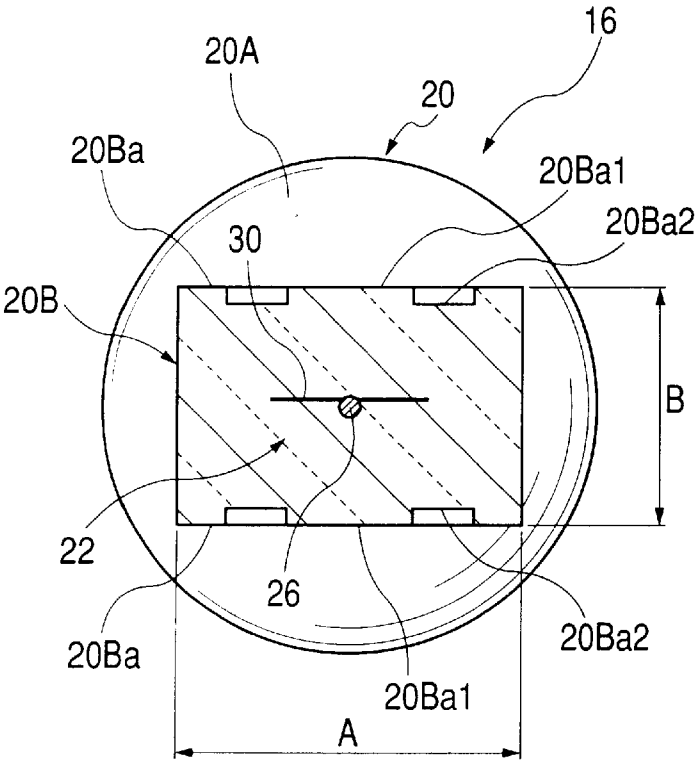
FIG. 5 is a section view taken along line V—V of FIG. 4.

FIG. 4 is a view looking in the direction of the arrow IV of FIG. 2, and FIGS. 5 and 6 are section views respectively taken along lines V—V and VI—VI of FIG. 4.

As shown in FIGS. 4–6, the front pinch seal portion 20B may have a substantially rectangular shape which forward elongates from the luminous tube portion 20A in a plan view, and may be formed into a size which is somewhat larger than the corresponding molybdenum foil 30. A pair of right and left neck portions 20C may be formed between the seal portion 20B and the luminous tube portion 20A. The rear pinch seal portion 20B may be configured in the same manner. Therefore, the following description is made of the front pinch seal portion 20B.

The pinch seal portion 20B may be set so as to have a section shape which laterally elongates, and which is substantially rectangular. Each of upper and lower faces 20B*a* of the pinch seal portion may consist of a usual part 20B*a*1 and a down-stepped flat part 20B*a*2.

The usual part 20B*a*1 may consist of a U-like region which longitudinally elongates so as to include a joining portion between the molybdenum foil 30 and the tungsten electrode 26, and an oval region which longitudinally elongates so as to include a portion where the molybdenum foil 30 is joined to the lead wire 28. The regions may be formed so as to be positioned in the same plane. In contrast, the down-stepped flat part 20B*a*2 may be configured by the whole region other than the usual part 20B*a*1, and may be formed into a flat shape which is downward stepped with respect to the usual part 20B*a*1.

In the pinch seal portion 20B, the width A may be set to A=3.8 to 4.6 mm, and the thickness B may be set to B=1.8 to 2.2 mm. The width A is the width dimension in the lateral direction, and the thickness B is the vertical dimension between the down-stepped flat parts 20B*a*2 of the upper and lower faces 20B*a*.

Figure 7:
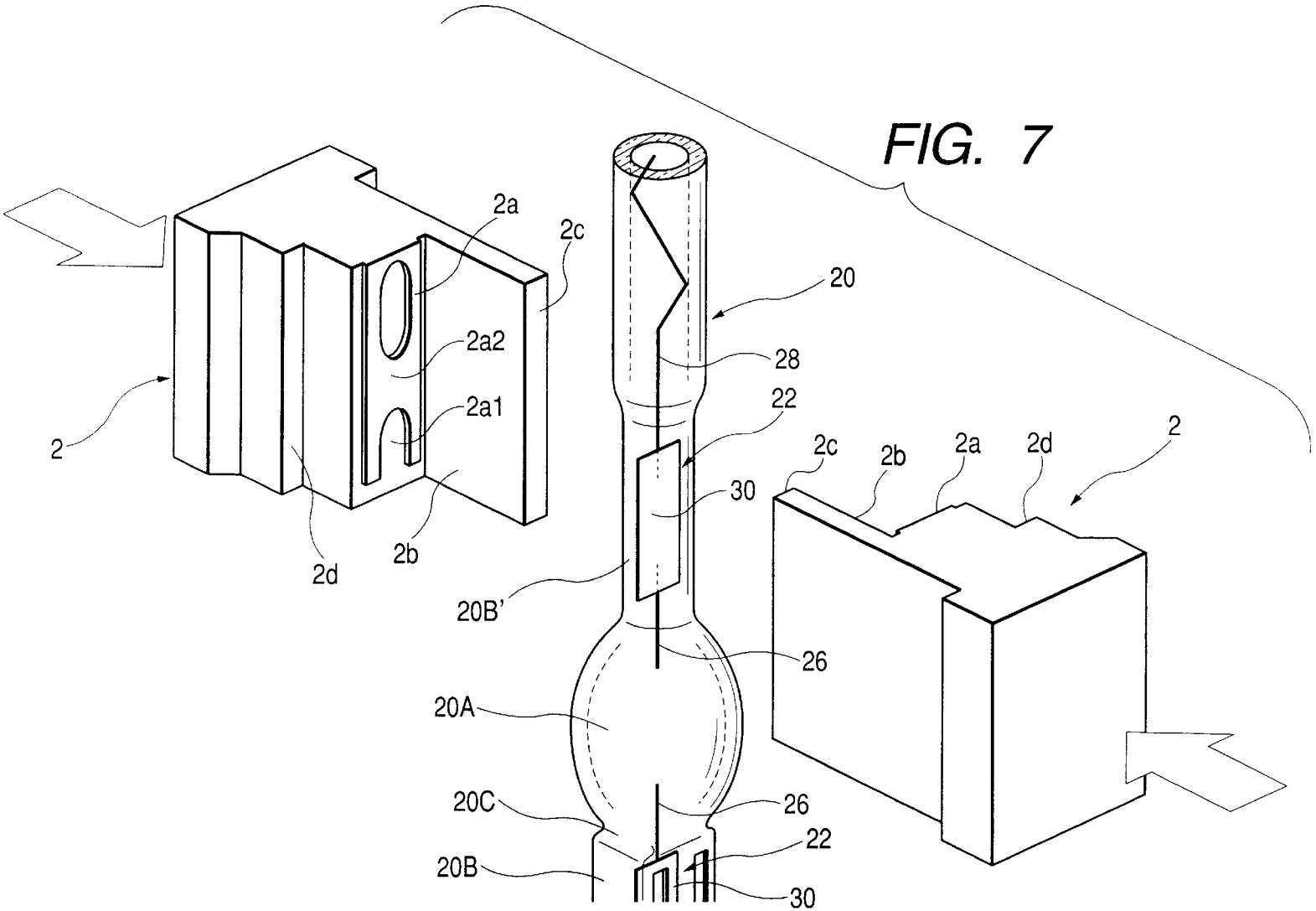
FIG. 7 is a perspective view showing a pinch sealing step of forming a front pinch seal portion in the arc tube.
Figure 8:
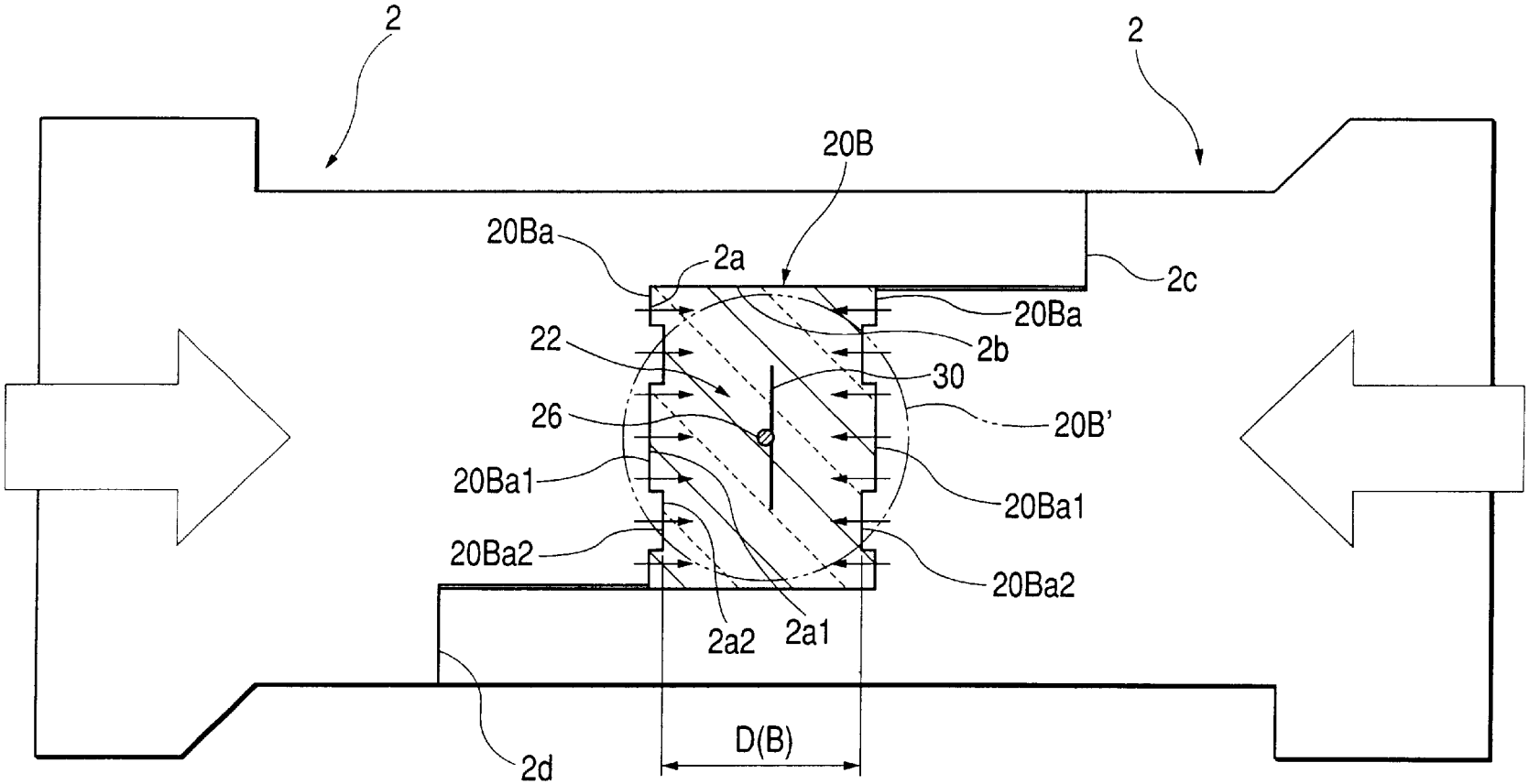
FIG. 8 is a plan section view showing the pinch sealing step.

FIGS. 7 and 8 are a perspective view and a plan section view showing a pinch sealing step of forming the front pinch seal portion 20B in accordance with a method of the invention.

As shown in FIGS. 7 and 8, in the pinch sealing step, under a state where the arc tube body 20 in which the rear pinch seal portion 20B is already formed is placed so that the front end is upward directed, a pair of pinchers 2 are pressed from the right and left sides against a pinch seal-to-be portion 20B' which is positioned above the luminous tube portion 20A, thereby forming the pinch seal portion 20B.

The pinchers 2 have a structure which is point-symmetric in a plan view. Each of the pinchers 2 may be formed with a front portion 2*a* for forming the upper and lower faces 20B*a* of the pinch seal portion 20B, a side face portion 2*b* for forming the side faces of the pinch seal portion 20B, a stopper portion 2*c* which is to abut against the counter pincher in a pinch sealing operation, and a stopper receiving portion 2*d* which is to receive the stopper portion 2*c* of the counter pincher. In the front portion 2*a* of each pincher 2, a usual part 2*a*1 and an up-stepped flat part 2*a*2, which correspond respectively to the usual part 20B*a*1 and the down-stepped flat part 20B*a*2 of the corresponding one of the upper and lower faces 20B*a* of the pinch seal portion 20B, are formed. A molding space for the pinch sealing operation is formed by causing the stopper portions 2*c* and the stopper receiving portions 2*d* of the two pinchers 2 to abut against each other. At this time, the thickness B of the pinch seal portion 20B may be determined by the distance D(B) between the up-stepped flat parts 2*a*2 of the front portions 2*a* of the two pinchers 2.

In the upper and lower faces 20B*a* of the pinch seal portion 20B, the U-like region and the oval region are set as the usual part 20B*a*1 in order to prevent the quartz glass in the joining portions between the molybdenum foil 30, and the tungsten electrode 26 and the lead wire 28 from being thinned and cracked. This setting of the U-like region and the oval region as the usual part 20B*a*1 can prevent the direction of the electrode assembly 22 (particularly the tip end part of the tungsten electrode 26) from being largely laterally deviated with respect to the longitudinal axis.

Figure 9:
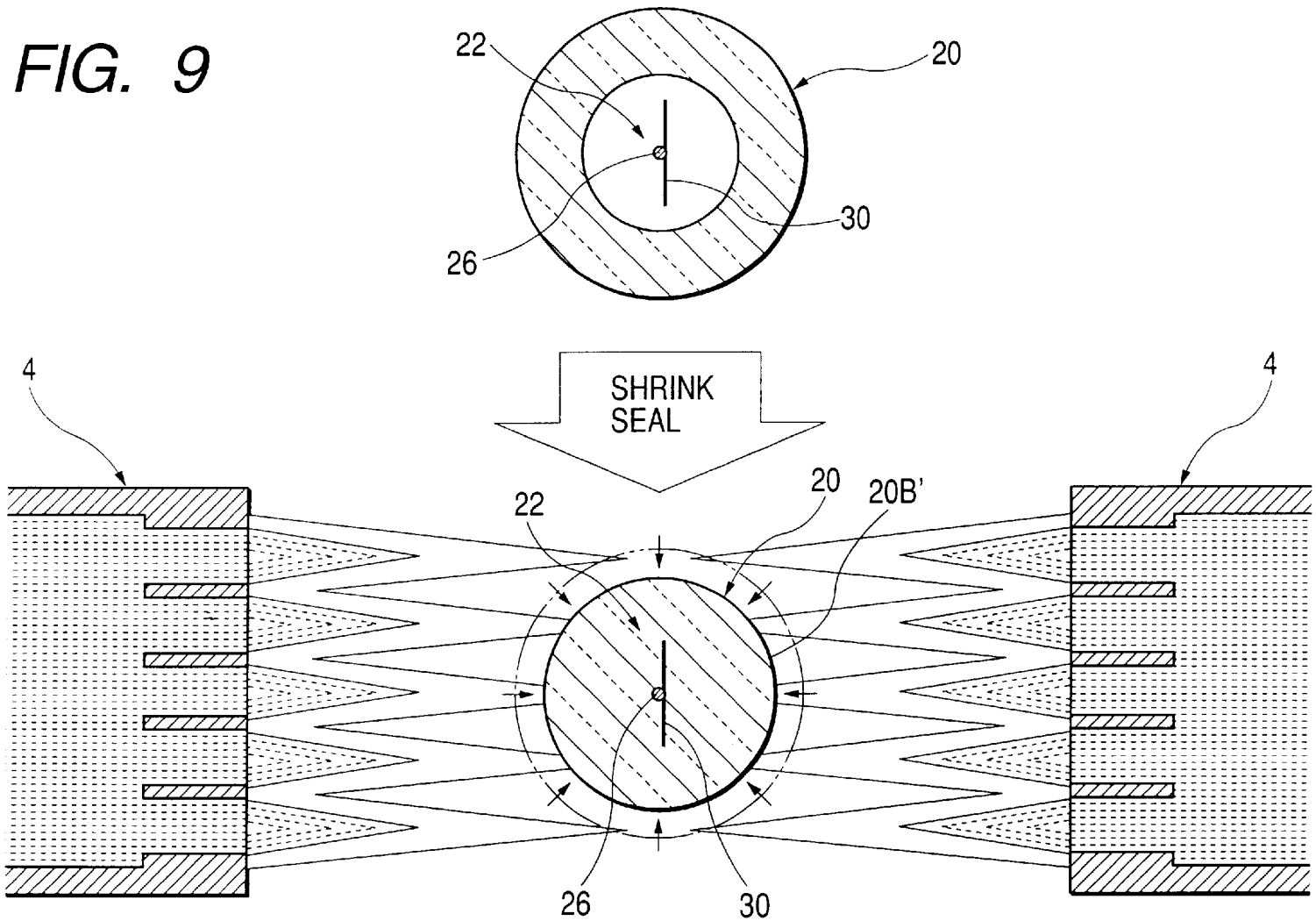
FIG. 9 is a plan section view showing a shrink sealing step preceding the pinch sealing step.

The pinch seal-to-be portion 20B' may have a solid structure, the diameter of which is smaller than that of a usual tubular hollow portion in the arc tube body 20. The electrode assembly may be positioned and then embedded in the portion. As shown in FIG. 9, the pinch seal-to-be portion 20B' is formed by, in a shrink sealing step preceding the pinch sealing step, heating from the right and left sides the arc tube body 20 into which the electrode assembly 22 has been inserted, by using a pair of burners 4, so that the arc tube body 20 heat shrinks over a predetermined length.

Figure 10:
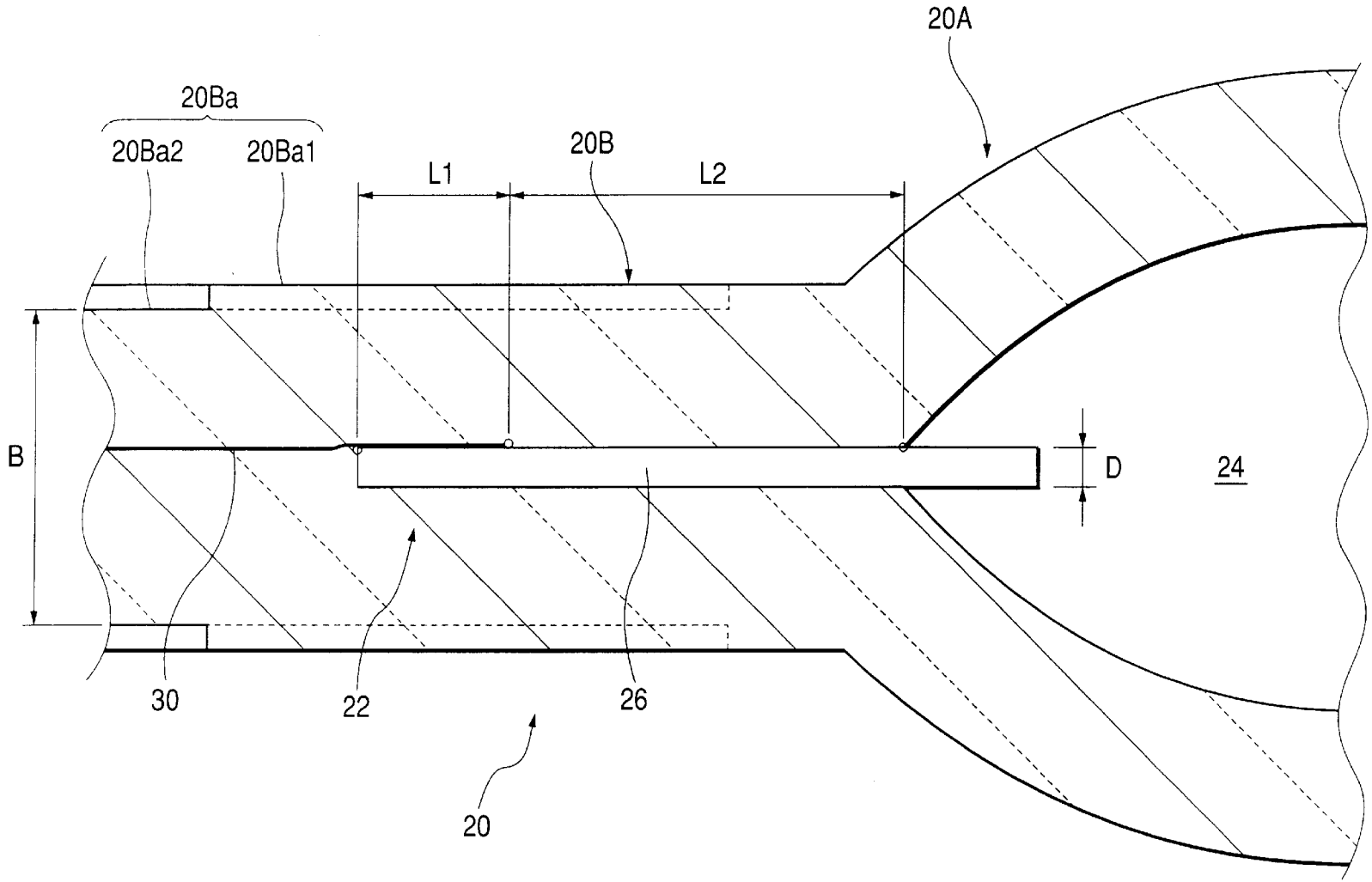
FIG. 10 is a detail view of main portions of FIG. 2.
Figure 11:
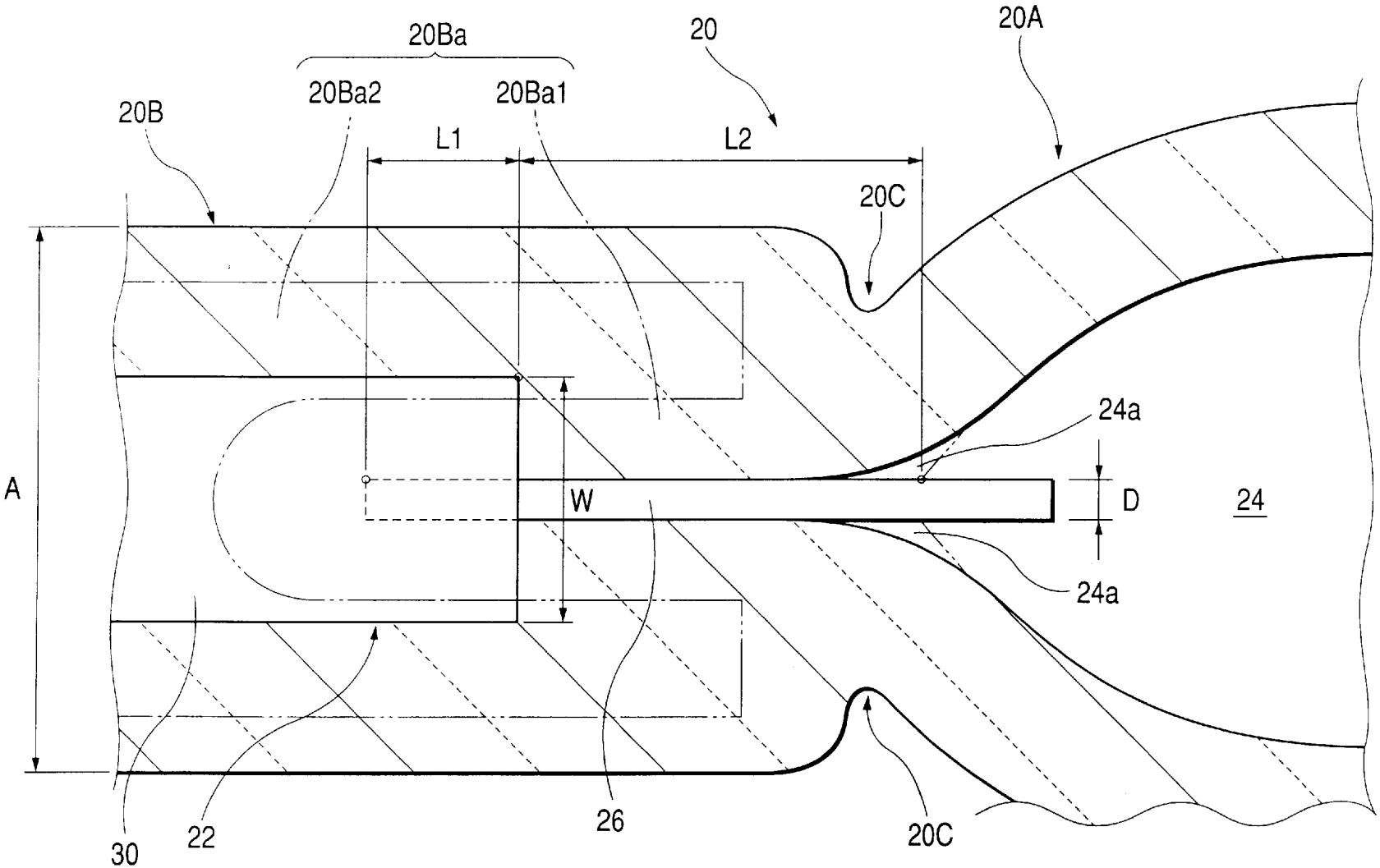
FIG. 11 is a detail view of main portions of FIG. 3.

FIGS. 10 and 11 are detail views of main portions of FIGS. 2 and 3, respectively.

As shown in FIGS. 10 and 11, the overlapped length L1 of the tungsten electrode 26 and the molybdenum foil 30 is set to be $2D \leqq L1 \leqq 0.8W$ with respect to the diameter D of the tungsten electrode 26 and the width W of the molybdenum foil 30. For example, L1=1 mm is set while D=0.2 mm and W=1.5 mm. Furthermore, the distance L2 between the molybdenum foil 30 and the discharge space 24 is set to be $B \leqq L2 \leqq 0.8A$ with respect to the width A and the thickness B of the pinch seal portion. For example, L2=2.5 mm is set while A=4.2 mm and B=2.2 mm.

As shown in FIG. 11, substantially wedge-like slits 24*a* are formed respectively on the right and lefts sides of the tungsten electrode 26 in each of the axial ends of the discharge space 24. As shown in FIG. 10, in contrast, such slits 24*a* are hardly formed on the upper and lower sides of the tungsten electrode 26 in each of the axial ends of the discharge space 24 because the pressing force of the corresponding pincher 2 in the pinch sealing operation directly acts on the upper and lower sides of the tungsten electrode. The distance L2 between the molybdenum foil 30 and the discharge space 24 is measured in a state where the arc tube body 20 is seen from a lateral side as shown in FIG. 10.

In the embodiment, the overlapped length L1 of the tungsten electrode 26 and the molybdenum foil 30 is set to be $2D \leqq L1 \leqq 0.8W$ because of the following reason.

Figure 13A:
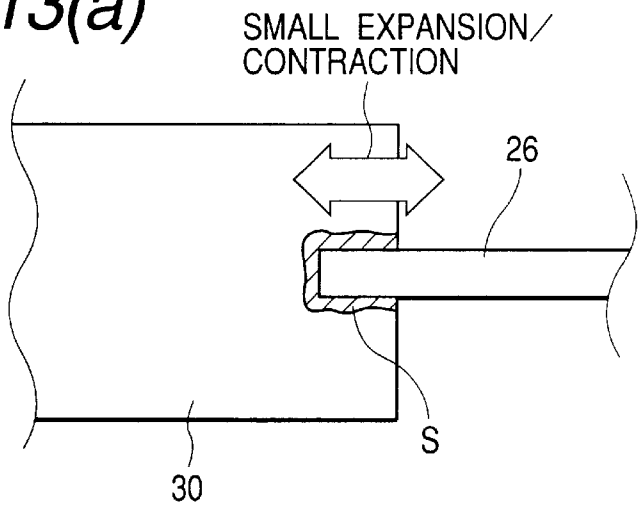
FIGS. 13(*a*) and 13(*b*) show views looking in the direction the arrow XIII of FIG. 12.
Figure 13B:
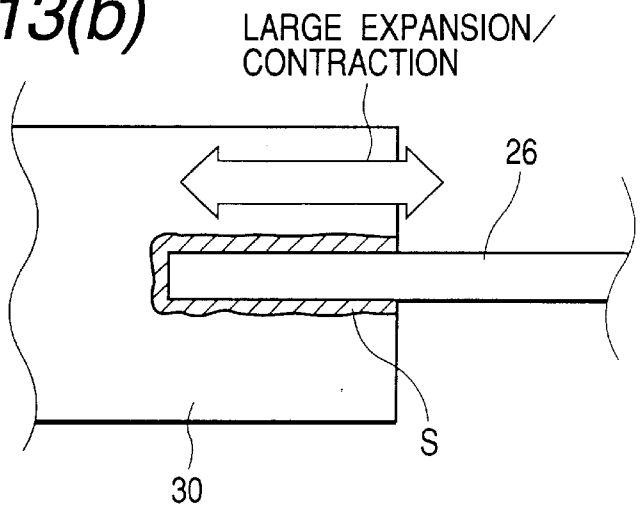
Figure 12:
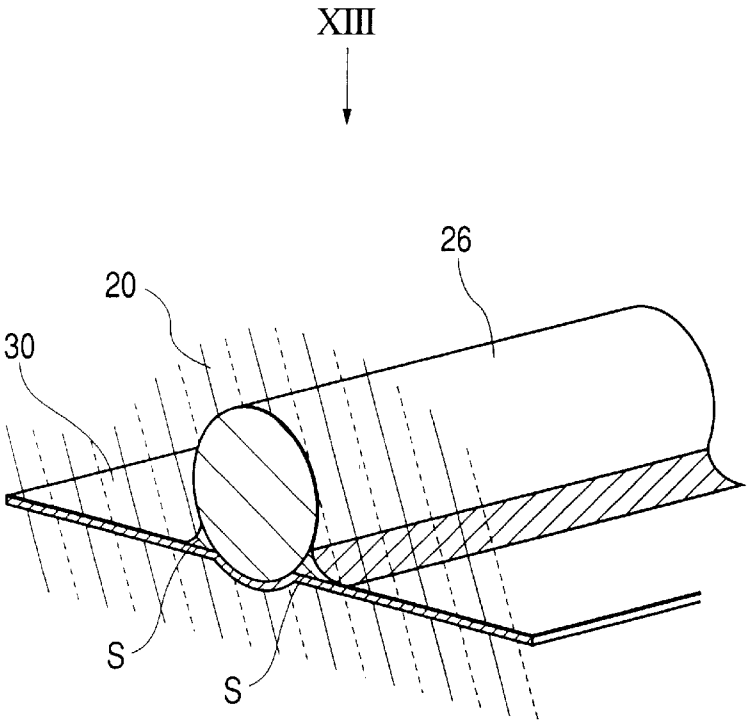
FIG. 12 is a perspective section view showing a welded portion between a tungsten electrode and a molybdenum foil of an electrode assembly which is pinch sealed into an arc tube body of the arc tube.
Figure 14:
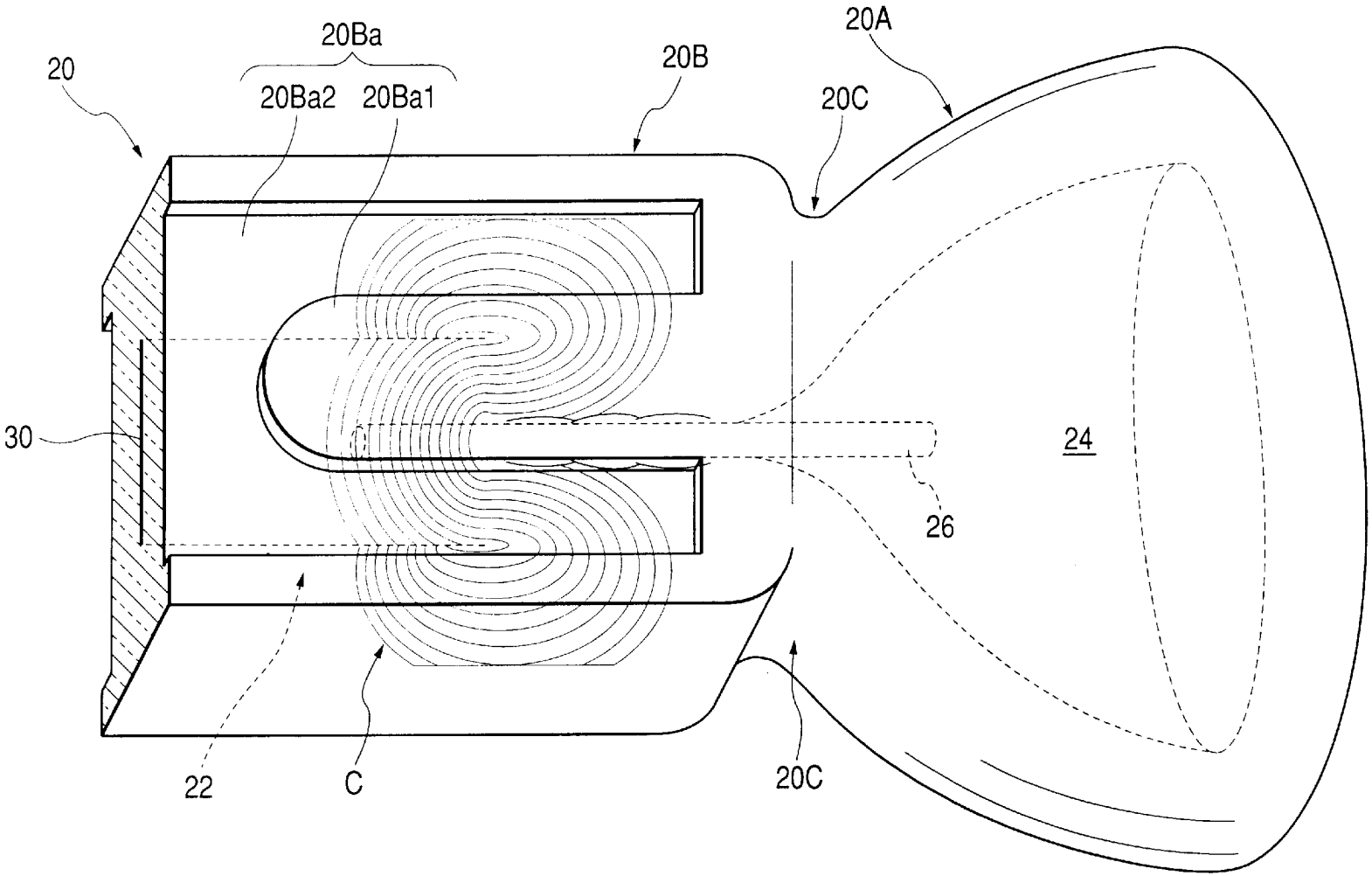
FIG. 14 is a perspective view of main portions and showing the state of cracks produced in the arc tube body starting from an end of the molybdenum foil.

As shown in FIG. 12, when the electrode assembly 22 is pinch sealed into the arc tube body 20, minute gaps S are formed between the arc tube body 20 and the periphery of the welded portion of the tungsten electrode 26 and the molybdenum foil 30. Peeling of the molybdenum foil 30 occurs starting from the gaps S. As the overlapped length L1 is longer, the proportion of the gaps S is greater, and hence peeling of the molybdenum foil 30 occurs more easily. As shown in FIG. 13, as a result of temperature changes due to turning-on and turning-off of the arc tube 16, the tungsten electrode 26 expands and contracts with respect to the arc tube body 20. As the overlapped length L1 is longer, the expansion and contraction of the tungsten electrode 26 produce a greater stress. Also from this viewpoint, peeling of the molybdenum foil 30 occurs easily. When such peeling once occurs, a crack C is produced in the arc tube body 20 with starting from an edge of the molybdenum foil 30 as shown in FIG. 14. When the crack C grows to reach the outer peripheral face of the arc tube body 20, leakage occurs between the discharge space 24 and the external space. Therefore, reduction of the overlapped length L1 to a value which is as small as possible is effective in suppression of occurrence of leakage due to peeling of the molybdenum foil 30.

Figure 15:
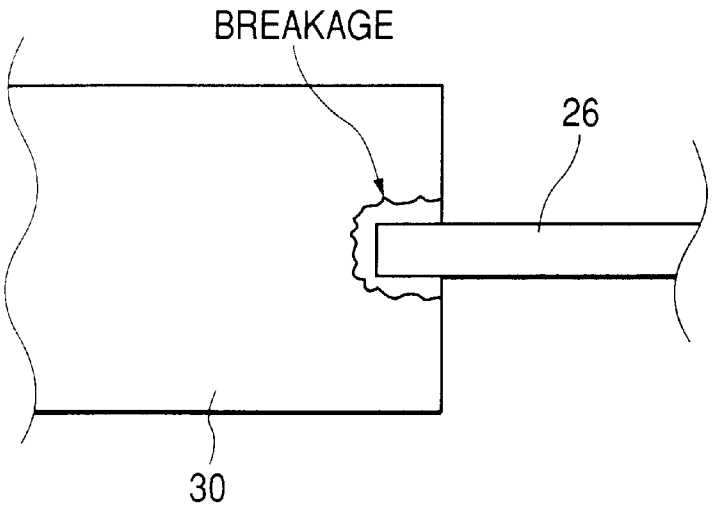
FIG. 15 is a view similar to FIG. 13 and showing the state of breakage of the molybdenum foil.
Figure 17:
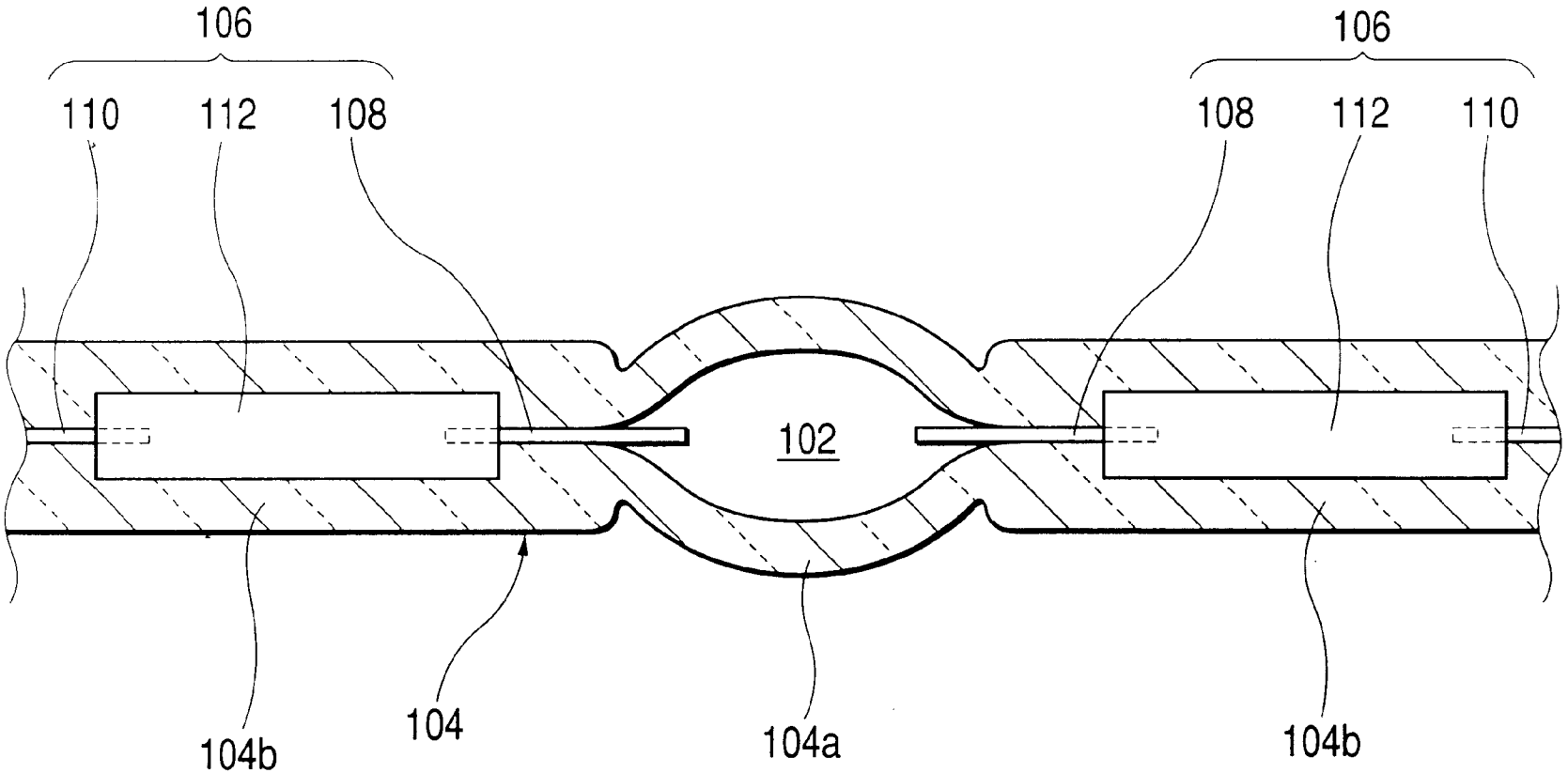
FIG. 17 PRIOR ART
FIG. 17 is a view depicting a conventional art example of an arc tube.

By contrast, when the overlapped length L1 is extremely reduced, it is physically impossible to join the tungsten electrode 26 to the molybdenum foil 30. In this joining, such as by welding, moreover, there is the possibility that the molybdenum foil 30 is broken in the portion overlapped by the tungsten electrode 26. Even in the case where the molybdenum foil 30 is not broken in the joining step, when the overlapped length L1 is extremely reduced, the strength of the periphery of the welded portion of the molybdenum foil 30 is largely reduced. Therefore, there is the possibility that, as shown in FIG. 15, the molybdenum foil is broken by the pinch seal pressure in the subsequent pinch sealing step, or that, when the arc tube 16 is turned on, the current flow is concentrated in the welded portion to fuse off the welded portion.

Table 1 below shows results of experiments which were conducted in order to investigate relationships between the overlapped length L1, and the life period of the arc tube 16 and occurrence of a welding defect. For each of the values of the overlapped length L1, ten samples were subjected to the experiments. As the samples, arc tubes were used in which the diameter D of the tungsten electrode 26 is D=0.2 mm, the width W of the molybdenum foil 30 is W=1.5 mm, the width A of each pinch seal portion is A=4.2 mm, and the thickness B of the pinch seal portion is B=2.2 mm.

TABLE 1

| | Overlapped length of molybdenum foil (L1) | | | | | | | | |
|---|---|---|---|---|---|---|---|---|---|
| L1 | 0.02 | 0.03 | 0.40 | 0.05 | 0.75 | 1.00 | 1.25 | 1.50 | 1.75 |
| Life period | ○ | ○ | ○ | ○ | ○ | ○ | Δ | x | x |
| Welding defect | x | x | Δ | Δ | ○ | ○ | ○ | ○ | ○ |

In the evaluation of "Life period" in Table 1, ○ indicates samples in which the average life period was 2,000 hours or longer, Δ indicates samples in which the average life period was 1,000 to 2,000 hours, and x indicates samples in which the average life period was shorter than 1,000 hours. The evaluation of "Welding defect" in Table 1 was conducted by visual inspection. In the evaluation of "Welding defect", ○ indicates samples in which welding was surely conducted and no crack was observed in the molybdenum foil 30, Δ indicates samples in which welding was surely conducted but a crack was observed in the molybdenum foil 30, and x indicates samples in which welding was not surely conducted or breakage was observed in the molybdenum foil 30.

As apparent from Table 1, when the overlapped length L1 is set to a value within the range of $2D \leqq L1 \leqq 0.8W$ (in the embodiment, $0.4\ mm \leqq L1 \leqq 1.2\ mm$), an average life period of 1,000 hours or longer can be ensured, and welding defects and breakage of the molybdenum foil 30 can be prevented from occurring.

In the embodiment, the distance L2 between the molybdenum foil 30 and the discharge space 24 is set to be $B \leqq L2 \leqq 0.8A$ because of the following reason. As the distance L2 between the molybdenum foil 30 and the discharge space 24 is shorter, the discharge luminous portion (the tip end part of the tungsten electrode 26) further approaches the molybdenum foil 30, and hence the temperature change of the overlapped portion of the tungsten electrode 26 and the molybdenum foil 30 becomes larger due to turning-on and turning-off of the arc tube 16. This increases the expansion and contraction of the tungsten electrode 26 in the overlapped portion with respect to the arc tube body 20. Therefore, the stress produced in the molybdenum foil 30 is increased so that peeling of the molybdenum foil 30 easily occurs. When such peeling once occurs, a crack C is produced in the arc tube body 20 starting from an edge of the molybdenum foil 30. When the crack C grows to reach the outer peripheral face of the arc tube body 20, leakage occurs between the discharge space 24 and the external space (see FIG. 14).

Figure 16:
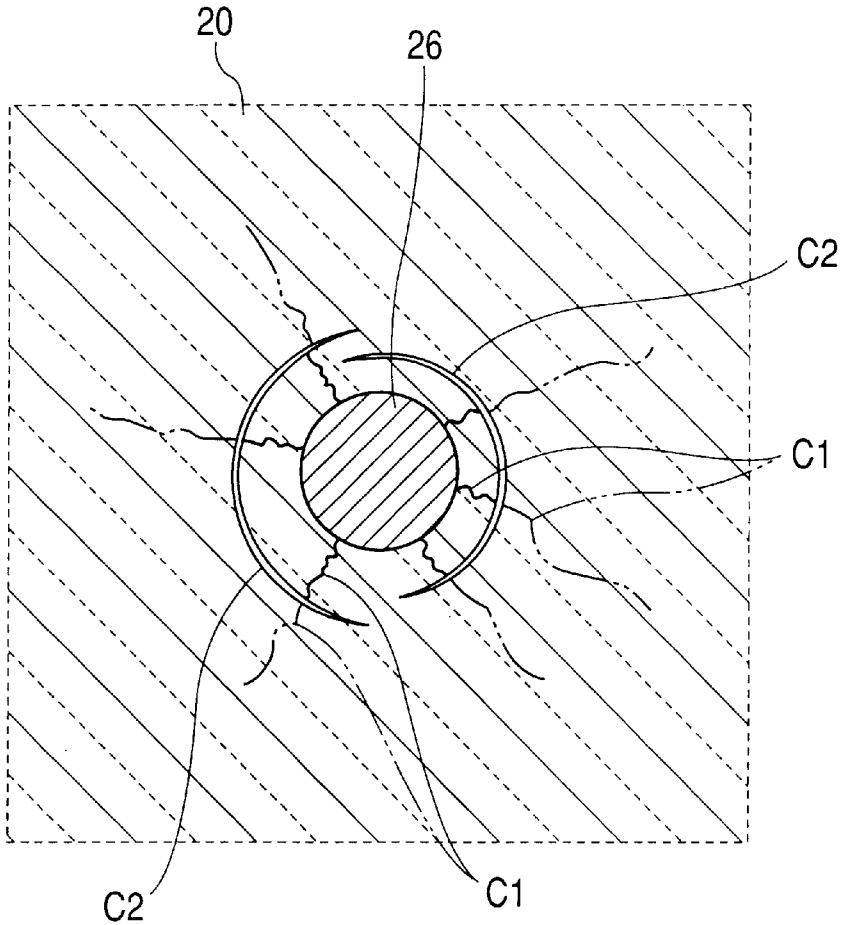
FIG. 16 is a detailed section view showing a state of the vicinity of a portion where the molybdenum foil is joined in the arc tube body.

By contrast, when the distance L2 between the molybdenum foil 30 and the discharge space 24 is long, there arises the following problem. As shown in FIG. 16, in a region in the vicinity of the joining face with the tungsten electrode 26 in the arc tube body 20, usually, a crack C1 which radially elongates from the joining face with the tungsten electrode 26, and a crack C2 which circumferentially elongates so as to surround the tungsten electrode 26 are caused by the difference in coefficient of thermal expansion between the tungsten electrode 26 and the arc tube body 20. The former is called electrode cracking. When the electrode cracking C1 grows to reach the outer peripheral face of the arc tube body 20, leakage occurs between the discharge space 24 and the external space. On the other hand, the latter is called bead cracking. When the bead cracking C2 is formed, the growth of the electrode cracking C1 is blocked. The bead cracking C2 occurs under the condition that the temperature distribution in the axial direction of the area of the pinch seal portion 20B where the tungsten electrode 26 is embedded is approximately even. When the distance L2 between the molybdenum foil 30 and the discharge space 24 is long, however, the temperature distribution in the axial direction of the area of the pinch seal portion 20B where the tungsten electrode 26 is embedded is considerably uneven, so that bead cracking C2 is hardly formed. Therefore, electrode cracking C1 easily grows to reach the outer peripheral face of the arc tube body 20.

Table 2 below shows results of experiments which were conducted in order to investigate relationships between the distance L2 between the molybdenum foil 30 and the discharge space 24, and occurrence of foil floating (peeling of the molybdenum foil 30) and electrode cracking C1. The investigation was conducted after the arc tubes were turned on for 1,000 hours. For each of the values of the distance L2, ten samples were subjected to the experiments. As the samples, arc tubes were used in which the diameter D of the tungsten electrode 26 is D=0.2 mm, the width W of the molybdenum foil 30 is W=1.5 mm, the width A of each pinch seal portion is A=4.2 mm, and the thickness B of the pinch seal portion is B=2.2 mm.

TABLE 2

| | Embedded length of tungsten electrode (L2) | | | | | | | | | | |
|---|---|---|---|---|---|---|---|---|---|---|---|
| L2 | 1.0 | 1.5 | 2.0 | 2.5 | 3.0 | 3.5 | 4.0 | 4.5 | 5.0 | 5.5 | 6.0 |
| Foil floating | x | x | Δ | ○ | ○ | ○ | ○ | ○ | ○ | ○ | ○ |
| Electrode cracking | ○ | ○ | ○ | ○ | ○ | Δ | x | x | x | x | x x |

The evaluation of "Foil floating" in Table 2 was conducted by visual inspection. In the evaluation, ○ indicates samples in which peeling of the molybdenum foil 30 did not occur, and those in which peeling of the molybdenum foil 30 occurred but the crack C elongating from the end of the molybdenum foil 30 did not occur in the arc tube body 20, Δ indicates samples in which peeling of the molybdenum foil 30 and the crack C of the arc tube body 20 occurred but the crack C was shorter than one half of the distance between the end of the molybdenum foil 30 and the outer peripheral face of the arc tube body 20, and x indicates samples in which peeling of the molybdenum foil 30 and the crack C of the arc tube body 20 occurred and the crack C was not shorter than one half of the distance between the end of the molybdenum foil 30 and the outer peripheral face of the arc tube body 20.

Also the evaluation of "Electrode cracking" in Table 2 was conducted by visual inspection. In the evaluation of "Electrode cracking", ○ indicates samples in which the bead cracking C2 was formed to prevent the electrode cracking C1 from growing into the outer peripheral region of the bead cracking C2, Δ indicates samples in which the bead cracking C2 was slightly insufficiently formed and hence the electrode cracking C1 partly grew into the outer peripheral region of the bead cracking C2, and x indicates samples in which the bead cracking C2 was insufficiently formed and hence the electrode cracking C1 grew into the outer peripheral face of the arc tube body 20.

As apparent from Table 2, when the distance L2 between the molybdenum foil 30 and the discharge space 24 of the luminous tube portion 20A is set to a value within a range of $B \leqq L2 \leqq 0.8A$ (in the embodiment, $2.2\ mm \leqq L2 \leqq 3.4\ mm$) with respect to the width A and the thickness B of the pinch seal portion 20B, occurrence of peeling of the molybdenum foil 30 can be effectively suppressed while effectively suppressing growth of the electrode cracking C1.

As described above in detail, in an embodiment of an arc tube 16 of the present invention, since the overlapped length L1 of the tungsten electrode 26 and the molybdenum foil 30 is set to be $2D \leqq L1 \leqq 0.8W$ with respect to the diameter D of the tungsten electrode 26 and the width W of the molybdenum foil 30, occurrence of peeling of the molybdenum foil 30 can be effectively suppressed while effectively suppressing occurrence of breakage of the molybdenum foil 30.

In the arc tube 16 of another embodiment of the present invention, since the distance L2 between the molybdenum foil 30 and the discharge space 24 of the luminous tube portion 20A is set to be $B \leqq L2 \leqq 0.8A$ with respect to the width A and the thickness B of the pinch seal portion 20B, occurrence of peeling of the molybdenum foil 30 can be effectively suppressed while effectively suppressing growth of the electrode cracking C1.

As described above, in another embodiment, occurrence of peeling of the molybdenum foil 30 can be effectively suppressed while effectively suppressing occurrence of breakage of the molybdenum foil 30 and growth of the electrode cracking C1. Therefore, occurrence of leakage due to peeling of the molybdenum foil 30 can be effectively suppressed, so that the life period of the arc tube 16 can be sufficiently prolonged.

In the present invention, an arc tube 16 of the discharge bulb 10 which is to be attached to an automobile headlight has been described. Also in an arc tube which is to be used for a purpose other than those described above, when the same configuration as that of the embodiment is employed, it is possible to attain the same functions and effects as those of the embodiment.

What is claimed is:

1. An arc tube comprising:

an arc tube body including a luminous tube portion and pinch seal portions formed at ends of the luminous tube portion constituting a discharge space; and a pair of electrode assemblies, each of which include a tungsten electrode and a molybdenum foil joined together in a partially overlapped state, the pair of electrode assemblies pinch sealed into the arc tube body into the pinch seal portions, respectively, and protruding a tip end part of each tungsten electrode into the discharge space, wherein an overlapped length L1 of the tungsten electrode and the molybdenum foil has a relationship of $2D \leqq L1 \leqq 0.8W$, where D is a diameter of the tungsten electrode and W is a width of the molybdenum foil.

2. An arc tube comprising:

an arc tube body including a luminous tube portion and pinch seal portions formed at ends of the luminous tube portion constituting a discharge space; and a pair of electrode assemblies, each of which include a tungsten electrode and a molybdenum foil joined together in a partially overlapped state, the pair of electrode assemblies pinch sealed into the arc tube body into the pinch seal portions, respectively, and protruding a tip end part of each tungsten electrode into the discharge space, wherein a distance L2 between the molybdenum foil and the discharge space has a relationship of $B \leqq L2 \leqq 0.8A$, where A is a width and B is a thickness of an associated pinch seal portion.

3. The arc tube according to claim 1, wherein a distance L2 between the molybdenum foil and the discharge space has a relationship of $B \leqq L2 \leqq 0.8A$, where A is a width B is a thickness of an associated pinch seal portion.

4. The arc tube according to claim 1, wherein the arc tube is formed of a glass material.

5. A method of forming an arc tube comprising:

forming a pair of electrode assemblies by partially overlapping and joining, for each electrode assembly, a tungsten electrode and a molybdenum foil, wherein during forming, an overlapped length L1 of the tungsten electrode and the molybdenum foil is set to have a relationship of $2D \leqq L1 \leqq 0.8W$, where D is a diameter of the tungsten electrode and W is a width of the molybdenum foil; and pinch sealing the pair of electrode assemblies into an arc tube body such that a tip end part of each tungsten electrode protrudes into a discharge space of the arc tube.

6. A method of forming an arc tube comprising:

forming a pair of electrode assemblies by partially overlapping and joining, for each electrode assembly, a tungsten electrode and a molybdenum foil;

inserting the pair of electrode assemblies into an arc tube body such that a tip end part of each tungsten electrode protrudes into a discharge space of the arc tube body; and pinch sealing the electrode assemblies to the arc tube body such that a distance L2 between the molybdenum foil and the discharge space has a relationship of $B \leqq L2$ 0.8A, where A is a width and B is a thickness of an associated pinch seal portion.

7. The method of claim 5, wherein during pinch sealing, a distance L2 between the molybdenum foil and the discharge space is set to have a relationship of $B \leqq L2 \leqq 0.8A$, where A is a width and B is a thickness of an associated pinch seal portion.

8. The arc tube of claim 1, wherein said width of the molybdenum foil is no more than 1.5 mm.

9. The method of claim 5, wherein said width of the molybdenum foil is no more than 1.5 mm.

10. The arc tube of claim 2, wherein said width of said associated pinch seal portion is no more than 7.5 mm and said thickness of said associated pinch seal portion is no less than 2.0 mm.

11. The method of claim 6, wherein said width of said associated pinch seal portion is no more than 7.5 mm and said thickness of said associated pinch seal portion is no less than 2.0 mm.

* * * * *